US011628549B2

(12) United States Patent
Theberath et al.

(10) Patent No.: US 11,628,549 B2
(45) Date of Patent: Apr. 18, 2023

(54) COMPRESSED AIR NAILER WITH SAFETY VALVE ASSEMBLY

(71) Applicant: Joh. Friedrich Behrens AG, Ahrensburg (DE)

(72) Inventors: Martin Theberath, Tangstedt (DE); Joachim Bauer, Bad Oldesloe (DE)

(73) Assignee: Joh. Friedrich Behrens AG, Ahrensburg (DE)

( * ) Notice: Subject to any disclaimer, the term of this patent is extended or adjusted under 35 U.S.C. 154(b) by 0 days.

(21) Appl. No.: 16/640,632

(22) PCT Filed: Aug. 14, 2018

(86) PCT No.: PCT/EP2018/071970
§ 371 (c)(1),
(2) Date: Feb. 20, 2020

(87) PCT Pub. No.: WO2019/038124
PCT Pub. Date: Feb. 28, 2019

(65) Prior Publication Data

US 2021/0138621 A1 May 13, 2021

(30) Foreign Application Priority Data

Aug. 23, 2017 (EP) ..... 17187512

(51) Int. Cl.
*B25C 1/04* (2006.01)
*B25C 1/00* (2006.01)

(52) U.S. Cl.
CPC ..... *B25C 1/043* (2013.01); *B25C 1/008* (2013.01)

(58) Field of Classification Search
CPC ..... B25C 1/008; B25C 1/043; B25C 1/046
(Continued)

(56) References Cited

U.S. PATENT DOCUMENTS 3,939,056 A 2/1976 Fueki
3,964,659 A 6/1976 Eiben et al.
(Continued)

FOREIGN PATENT DOCUMENTS

CN 2150022 Y 12/1993
CN 102186634 A 9/2011
(Continued)

OTHER PUBLICATIONS

JP Application No. 20200508045; filed Aug. 14, 2018; Office Action dated Jul. 1, 2021 (2 pages).
(Continued)

*Primary Examiner* — Anna K Kinsaul
*Assistant Examiner* — Veronica Martin
(74) *Attorney, Agent, or Firm* — Barclay Damon LLP

(57) ABSTRACT

A compressed air nailer comprises a working piston connected to a driving tappet configured to drive a fastener. A trigger and a placing sensor are configured to be actuated to aerate or deaerate a main control line to enable triggering of the driving process. A control valve assembly is configured to define a locked position and an open position by controlling a first pressure in a first control space and a second pressure in a second control space. The first control space is connected to the trigger valve and actuation of the trigger valve is configured to bring the safety valve assembly into the locked position. When the safety valve assembly is in the open position, an actuation of the placing sensor valve is configured to bring the safety valve assembly into the open position when the trigger valve is actuated.

17 Claims, 13 Drawing Sheets

(58) Field of Classification Search
USPC ..... 227/8, 130
See application file for complete search history.

(56) References Cited

U.S. PATENT DOCUMENTS

| | | | | |
|---|---|---|---|---|
| 4,915,013 | A * | 4/1990 | Moraht | B25C 1/043 227/130 |
| 5,522,532 | A | 6/1996 | Chen | |
| 5,645,208 | A | 7/1997 | Haytayan | |
| 7,556,183 | B1 | 7/2009 | Liang et al. | |
| 2009/0302087 | A1* | 12/2009 | Liang | B25C 1/043 227/130 |
| 2010/0012698 | A1* | 1/2010 | Liang | B25C 1/043 227/8 |
| 2010/0012699 | A1 | 1/2010 | Liang et al. | |
| 2014/0231485 | A1 | 8/2014 | Bauer | |
| 2016/0114470 | A1 | 4/2016 | Weigmann et al. | |
| 2017/0209995 | A1* | 7/2017 | Iijima | B25C 1/043 |

FOREIGN PATENT DOCUMENTS

| | | | |
|---|---|---|---|
| CN | 203973491 | U | 12/2014 |
| CN | 104511882 | A | 4/2015 |
| DE | 102013106657 | A1 | 1/2015 |
| EP | 2767365 | B1 | 12/2016 |
| JP | 1976-148873 | A | 6/1978 |
| JP | 1990-107263 | A | 1/1992 |
| JP | 2017131994 | A | 8/2017 |
| RU | 2706905 | C1 | 11/2019 |
| SU | 537809 | A1 | 12/1976 |

OTHER PUBLICATIONS

JP Application No. 20200508045; filed Aug. 14, 2018; English translation of Office Action dated Jul. 1, 2021 (2 pages).
Russian Application No. 2020110228/05; filed Aug. 14, 2018; Office Action dated Dec. 16, 2021 (7 pages).
Russian Application No. 2020110228/05; filed Aug. 14, 2018; Search Report dated Dec. 14, 2021 (2 pages).
Russian Application No. 2020110228/05; filed Aug. 14, 2018; English translation Office Action dated Dec. 16, 2021 (7 pages).
JP Application No. 20200508045; filed Aug. 14, 2018; Decision to Grant dated Feb. 21, 2022 (3 pages).
JP Application No. 20200508045; filed Aug. 14, 2018; English translation of Decision to Grant dated Feb. 21, 2022 (3 pages).
Russian Application No. 2020110228/05; filed Aug. 14, 2018; Decision on Granting dated Aug. 15, 2022 (17 pages).
Chinese Application No. 201880053950.7; filed Aug. 14, 2018; Office Action dated Sep. 30, 2022 (5 pages).
AU Application No. 2018319253; filed Aug. 14, 2018; AU Notice of Acceptance dated Feb. 9, 2023 (3 pages).

* cited by examiner

COMPRESSED AIR NAILER WITH SAFETY VALVE ASSEMBLY

CROSS REFERENCE TO RELATED INVENTION

This application is a national stage application pursuant to 35 U.S.C. § 371 of International Application No. PCT/EP2018/071970, filed on Aug. 14, 2018, which claims priority to, and benefit of, European Patent Application No. 17 187 512.3, filed Aug. 23, 2017, the entire contents of which are hereby incorporated by reference.

BACKGROUND

The invention relates to a compressed air nailer which comprises a trigger, a placing sensor and a control valve arrangement or assembly. If the compressed air nailer is placed onto a workpiece, the placing sensor is displaced counter to the force of a spring until an outlet tool bears, or almost bears, against the workpiece. Only when the placing sensor has been actuated in this manner is a driving process able to be triggered. As a result, relative to devices without a placing sensor, compressed air nailers provide considerably improved safety relative to unintentional triggering.

Some compressed air nailers of the type described above may be used in two different operating modes: with so-called individual triggering the compressed air nailer is initially placed onto a workpiece and, as a result, the placing sensor is actuated. Subsequently, the trigger is actuated manually and as a result an individual driving process is triggered. With so-called contact triggering, also denoted as "touching", the user already holds the trigger pressed down while the compressed air nailer is placed onto the workpiece. When placed onto the workpiece the placing sensor is actuated and, as a result, a driving process is triggered. The compressed air nailer may be placed repeatedly in rapid succession which permits a very rapid operation, in particular when for sufficient fastening a plurality of fastening means have to be driven in, only low requirements being set for the positional accuracy thereof.

In specific situations, however, an increased risk of injury arises from the contact triggering method. If the user holds the manually actuated trigger pressed down, for example, not only when he wishes to position the compressed air nailer onto one and the same workpiece at a spacing of a few centimetres from the previously driven-in fastening means, but also when he changes to a different workpiece arranged at a distance therefrom, a driving process may be triggered by an unintentional contact of an object or body part with the placing sensor. For example, it may lead to accidents when a user (by ignoring important safety rules) climbs on a ladder with the compressed air nailer, holds the trigger pressed down and unintentionally touches the placing sensor with his or her leg.

Some known compressed air nailers attempt to reduce this risk associated with the contact triggering mode by contact triggering only being possible for a short time period after actuating the trigger or respectively, after a driving process. If the time period has elapsed, the trigger first has to be released again. An example thereof has been disclosed in the publication EP 2 767 365 B1. The compressed air nailer disclosed therein has a trigger and a placing sensor, in each case a control valve being assigned thereto. Moreover, the known device has a safety control chamber, the pressure thereof acting on a locking piston. In a specific position of the locking piston the triggering of a driving process is prevented. The safety control chamber is aerated via the control valve assigned to the trigger and a throttle. As a result, after actuating the trigger contact triggering is only possible until the pressure in the safety control chamber has exceeded a predetermined pressure threshold. Subsequently, the compressed air nailer is locked until the trigger is released and the pressure in the safety control chamber has dropped again below the pressure threshold.

A similar functionality is provided by the compressed air nailer which has been disclosed in U.S. Pat. No. 3,964,659 which may also be used in individual triggering mode and in contact triggering mode and in which a trigger and a placing sensor are coupled together mechanically via a rocker. The rocker acts on a control valve in order to trigger a driving process by deaerating a main control line. If merely the trigger is actuated but not the placing sensor, a control pin of the control valve is only displaced over part of its displacement path. This semi-actuation of the control valve leads to a slow aeration of a control chamber via a small aeration opening. The pressure prevailing in the control chamber acts on a valve sleeve which surrounds the control valve and finally displaces this valve sleeve into a locked position in which a complete actuation of the valve pin is no longer able to deaerate the main control line, so that contact triggering is not possible.

A further improvement to safety may be achieved if a first driving process always has to be carried out for each individual triggering. In this case, for the first driving process the device has to be initially placed onto the workpiece, whereby the placing sensor is actuated. A subsequent actuation of the trigger then triggers the first driving process. Subsequently, within a short time period further driving processes may take place for each contact triggering, i.e. by repeatedly lifting and placing the device onto the workpiece with the trigger continually actuated. This functionality is disclosed in the compressed air nailer described in the publication DE 10 2013 106 657 A1. To this end, a trigger and a placing sensor are mechanically coupled via a rocker which acts on a control valve in order to trigger a driving process. With each driving process a pressure is built in a control chamber which acts on a mechanical actuating member. The control chamber is slowly deaerated via a deaeration opening. The actuating member reaches a locked position depending on the pressure in the control chamber, whereby a mechanical action of the placing sensor on the rocker is prevented when the trigger is actuated and contact triggering becomes impossible.

BRIEF SUMMARY OF THE INVENTION

Proceeding therefrom, it is the object of the invention to provide a compressed air nailer with an effective, robust and reliable safety mechanism.

In an embodiment, a compressed air nailer comprise a working piston which is connected to a driving tappet for driving in a fastening means and which is subjected to compressed air when a driving process is triggered. The compressed air nailer further comprises a trigger and a placing sensor, the common actuation thereof aerates or deaerates a main control line and as a result a driving process is able to be triggered. A control valve arrangement is provided which has a trigger valve assigned to the trigger and a placing sensor valve assigned to the placing sensor. A safety valve arrangement or assembly is provided which is displaceable between a locked position and an open position by controlling the pressure in a first control space and the pressure in a second control space. The main control line in the open position is connected to the control valve arrangement and in the locked position is not connected to the control valve arrangement. The first control space is connected to the trigger valve such that an actuation of the trigger valve attempts to bring the safety valve arrangement into the locked position. In the open position, the second control space is connected to the placing sensor valve such that an actuation of the placing sensor valve always attempts to bring the safety valve arrangement into the open position when the trigger valve is actuated.

In an embodiment, the compressed air nailer is used for driving in fastening means, such as nails, tacks or staples. To this end, the compressed air nailer may have a magazine for the fastening means, in each case a fastening means being supplied therefrom to a receiver of an outlet tool of the compressed air nailer. When triggering a driving process, a working piston of the compressed air nailer is subjected to compressed air. In this case, the working piston drives a driving tappet which is connected to the working piston. The driving tappet strikes a rear end of the fastening means in the receiver of the outlet tool and drives the fastening means into the workpiece.

The placing sensor, in an embodiment, may be a mechanical component which protrudes over the front end of the outlet tool and is held in this position by a spring until the compressed air nailer is placed onto a workpiece. Then the placing sensor is displaced counter to the direction of the spring force and counter to the driving direction until an outlet tool of the compressed air nailer bears, or almost bears, against the workpiece.

In an embodiment, the compressed air nailer has a main control line which is aerated or deaerated for triggering a driving process. In order to permit this aeration or deaeration of the main control line, the main control line is connected to the control valve arrangement in the open position of the safety valve arrangement. The driving process may be initiated by means of the main control line in different ways. An embodiment with a main valve and a pilot valve which is activated via the main control line is known, for example. Details thereof will be described relative to the exemplary embodiment. However, other designs with or without a pilot valve are also conceivable. It is merely relevant to the invention that the driving process may be triggered by the aeration or deaeration of the main control line.

In an embodiment, the control valve arrangement comprises two valves, in each case a mechanical actuating element being assigned thereto or associated with. In this case it is the trigger valve which is actuated by the trigger to be actuated manually, and the placing sensor valve which is actuated or may be actuated by the placing sensor, i.e. when placing the compressed air nailer onto a workpiece.

A particularity of the invention is in the safety valve arrangement. In an embodiment, it is a pressure-controlled valve arrangement with two control spaces. The pressures in the two control spaces act on the safety valve arrangement or respectively, on at least one displaceable actuating member of the safety valve arrangement, so that by controlling these pressures the safety valve arrangement may be displaced between a locked position and an open position.

The safety valve arrangement performs two important functions. Firstly it controls whether the main control line is connected to the control valve arrangement. Only when this is the case may a driving process be triggered by means of the control valve arrangement. Thus the safety valve arrangement prevents the triggering of a driving process if it is in the locked position. Secondly, the position of the safety valve arrangement is significant as to whether a connection is present or not between the placing sensor valve and the second control space. In the open position, this connection is present so that an actuation of the placing sensor valve may influence the pressure in the second control space. If the safety valve arrangement, however, is in the locked position, the aforementioned connection is not present and an actuation of the placing sensor valve has no significant influence on the pressure in the second control space.

The first control space is connected to the trigger valve such that an actuation of the trigger valve attempts to bring the safety valve arrangement into the locked position. This means that via the connection between the trigger valve and the first control space a force is exerted on a displaceable element of the safety valve arrangement in the direction of the locked position. Depending on the embodiment, this may be effected by an aeration of the first control space but also, for example, by a deaeration of the first control space. The connection between the trigger valve and the first control space may be present irrespective of the position of the safety valve arrangement.

This solution has the result that starting from an initial state of the compressed air nailer a driving process may only be triggered by actuating the placing sensor and the trigger in a specific sequence. If the trigger is actuated first, the connection of the trigger valve to the first control space effects a displacement of the safety valve arrangement into the locked position. A subsequent actuation of the placing sensor and the assigned placing sensor valve may no longer act on the second control space so that the safety valve arrangement remains in the locked position and a driving process is not triggered. If, however, the placing sensor is actuated first, whilst the safety valve arrangement is in its open position, the pressure in the second control space may be influenced such that the safety valve arrangement remains in its open position when the trigger, and thus the trigger valve, is subsequently actuated. To this end, the two control spaces of the safety valve arrangement may be configured such that the forces exerted by the pressures in the two control spaces onto the safety valve arrangement, optionally by including further forces acting on the safety valve arrangement, hold the safety valve arrangement in the open position or displace it into the open position.

Whilst the compressed air nailer is in a basic state, for example after the start-up of the compressed air nailer (for example by connecting the compressed air nailer to a compressed air source) or after an operating pause, in principle, it is not possible to trigger a driving process by the trigger being actuated first and then, when the trigger is actuated, the placing sensor being actuated.

The described influence of the pressure in the second control space by actuating the placing sensor valve occurs in any case when the trigger is actuated. The control valve arrangement may optionally also be configured such that the action of the placing sensor valve on the second control space occurs irrespective of the state of the trigger valve. This is, however, not necessary for the described function.

With an actuation of the placing sensor valve in the open position, the second control space is connected to the placing sensor valve such that an actuation of the placing sensor valve always attempts to bring the safety valve arrangement into the open position when the trigger valve is actuated. This means that an actuation of the placing sensor valve influences the pressure in the second control space such that a force is exerted on a movable element of the safety valve arrangement in the direction of the open position. This occurs at least when the trigger valve is actuated at the same time. The action of the placing sensor valve on the second control space may be present with an aeration of the second control space, depending on the design of the safety valve arrangement, but also for example a deaeration of the second control space comes into consideration when the placing sensor valve is actuated.

In one embodiment, the safety valve arrangement comprises a single actuating member which is displaceable between the locked position and the open position, wherein a pressure in the first control space exerts a first force onto the actuating member and a pressure in the second control space exerts a second force onto the actuating member counter to the first force. As explained, the safety valve arrangement is responsible for producing or disconnecting two connections, namely on the one hand, between the main control line and the trigger valve and, on the other hand, between the placing sensor valve and the second control space. These functions, in principle, may be performed by means of separate actuating members. The use of a single actuating member is, however, particularly simple relative thereto. In particular, the two control spaces may be arranged on opposing sides of the actuating member, so that the forces exerted by the respective pressures onto the actuating member are automatically oriented in opposing directions. The extent of the actions of the two forces may be dictated by a suitable selection of the surfaces of the actuating member on which the pressures act, in particular such that with a simultaneous action of both forces the actuating member remains in the open position.

In one embodiment, the compressed air nailer comprises a spring which exerts a force onto the actuating member in the direction of the open position. As a result, it may be achieved that in the initial state of the compressed air nailer the actuating member is in a defined position, namely in the open position.

In one embodiment, each actuation of the trigger valve effects an aeration of the first control space. To this end, an inlet of the trigger valve may be connected to a housing interior conducting compressed air, and an outlet of the trigger valve may be continuously connected to the first control space via a line. As a result, in principle, with each actuation of the trigger the safety valve arrangement reaches the locked position, provided the pressure in the second control space does not lead to sufficiently large forces oriented in the opposing direction.

In one embodiment, the trigger valve is actuated with each actuation of the trigger, irrespective of a position of the placing sensor. The trigger acts, therefore, directly on the trigger valve, in particular by a contact surface of the trigger acting on a valve pin of the trigger valve. A mechanical coupling which is costly and potentially susceptible to failure between the trigger and placing sensor, for example via a rocker, is not required.

In one embodiment, the placing sensor valve is actuated with each actuation of the placing sensor, irrespective of a position of the trigger. Also in this case the placing sensor thus acts directly on the placing sensor valve, for example with an actuating surface of the placing sensor which acts on a valve pin of the placing sensor valve. Also in this case a mechanical coupling between the trigger and the placing sensor which is costly and potentially susceptible to failure may be dispensed with.

In one embodiment, the main control line in the open position is connected to an outlet of the placing sensor valve and an inlet of the placing sensor valve is connected to an outlet of the trigger valve. The trigger valve and the placing sensor valve are, therefore, arranged in series so that for influencing the pressure in the main control line both aforementioned valves have to be actuated. This applies, in particular, to an aeration of the main control line, for which it is provided to connect an inlet of the trigger valve to a housing interior conducting compressed air. In this case, the compressed air is conducted from this housing interior via the trigger valve and the placing sensor valve into the main control line if the two valves are actuated at the same time. As a result, it is achieved in a particularly simple manner and without additional mechanical coupling elements that, in principle, a driving process may only be triggered when the two valves are actuated at the same time.

In one embodiment, a non-return valve is arranged in a line which in the open position connects the placing sensor valve to the second control space. The non-return valve may be oriented such that by means of the placing sensor valve, exclusively an aeration or exclusively a deaeration of the second control space is possible. In both cases, the non-return valve may lead to the pressure prevailing in the second control space being maintained, irrespective of the position of the placing sensor valve.

In one embodiment, the second control space is deaerated via a throttle and is connected to a storage chamber. The volume of the storage chamber and the opening cross section of the throttle may be selected such that the pressure ratios produced in the second control space by means of the placing sensor valve are maintained for a time period of, for example, 0.5 seconds to 10 seconds such that the safety valve arrangement remains in the open position. Within this time period, therefore, contact triggering is possible.

In one embodiment, the safety valve arrangement in the locked position deaerates the second control space. As a result, the pressure in the second control space may be reset with each response of the safety valve arrangement, i.e. always when the safety valve arrangement reaches the locked position. This leads to the safety valve arrangement reliably remaining in the locked position but only as long as the pressure ratios in the first control space are not altered.

In one embodiment, the safety valve arrangement in the locked position deaerates the main control line. This safety measure counteracts an inadvertent triggering of a driving process.

In one embodiment, the safety valve arrangement has a locking sleeve as an actuating member, the placing sensor valve being arranged therein. By this structural measure a particularly compact design may be achieved.

In one embodiment, the placing sensor valve comprises a fixedly arranged valve sleeve and a displaceable valve pin guided therein, wherein the locking sleeve surrounds the valve sleeve and cooperates therewith. This measure also promotes a compact design.

In one embodiment, the non-return valve is formed by an O-ring which is inserted into a peripheral groove of the valve sleeve. Such a non-return valve may be inserted into the tightest space between the locking sleeve and the valve sleeve.

In principle, the storage chamber which is connected to the second control space can be a single storage chamber, i.e., can be formed by a single contiguous volume. In one embodiment, however, the storage chamber comprises a first storage chamber and a second storage chamber which are connected to each other via a further throttle. It is therefore divided into two partial volumes, between which an exchange of air only occurs via the further throttle. The slow deaeration of the storage chamber via the throttle which is also provided in this embodiment can be achieved by arranging the throttle in a line which connects the second storage chamber and/or the first storage chamber to external air. The volumes of the two storage chambers can be the same size or different sizes. In particular, the second storage chamber can be larger than the first storage chamber, for example by a factor of at least 2, at least 5 or at least 10. The opening cross sections of the two throttles can be the same size or different sizes, in particular the further throttle can have a larger opening cross section than the throttle. By dividing the storage chamber into a first and a second storage chamber, a different dynamic behaviour of the pressure prevailing in the second control space can be achieved. In particular, the pressure required for the described function can be built rapidly in the second control space by feeding air into a partial volume of the storage chamber, for example into the first storage chamber, via the inflow from the control valve arrangement. This ensures that the safety valve arrangement remains in the open position even when in particular the placing sensor is only actuated for a very short time.

In one embodiment, a retraction chamber of the compressed air nailer is connected to the second storage chamber via a further non-return valve, wherein the second control space is connected to the first storage chamber. The retraction chamber can annularly surround a working cylinder of the compressed air nailer and/or be aerated from the working volume with every working cycle via a non-return valve. After completion of a driving process, the compressed air stored in this manner in the retraction chamber is used to move the working cylinder back into its initial position. In the embodiment of the invention, the compressed air from the retraction chamber is additionally used for aerating the second storage chamber. A particular advantage of this solution is that, in this way, a greater amount of compressed air is potentially available for aerating the storage chamber than via the control valve arrangement. Therefore, a relatively large storage chamber can be readily, quickly and reliably aerated. This in turn permits a sufficiently slow deaeration of the storage chamber via the throttle, even when the throttle has a relatively large opening cross section. A relatively large opening cross section is typically less susceptible to malfunction and easy to produce. A small bore with a diameter in the range of, for example, 0.1 mm to 1 mm is particularly suitable as a throttle.

In one embodiment, the compressed air nailer has a storage chamber aeration valve which is activated by the control valve arrangement and is configured to aerate the second storage chamber, wherein the second control space is connected to the first storage chamber. The storage chamber aeration valve can in particular produce a connection between a housing interior which is always aerated and the second storage chamber. The storage chamber aeration valve can have a single actuating member which is displaceable independently of other displaceable parts of the compressed air nailer. However, a different actuating member, for example an actuating member of the pilot valve or of another valve of the compressed air nailer, can also be used for opening and closing a connection via which the second storage chamber is aerated. The activation of the storage chamber aeration valve takes place via the control valve arrangement so that, when the trigger and the placing sensor are actuated together, the storage chamber aeration valve is actuated and the second storage chamber is aerated. This activation of the storage chamber aeration valve can take place in particular via the main control line. In this case, an actuating member of the storage chamber aeration valve can be displaced into an open position by the pressure prevailing in the main control line, while it is held in or respectively displaced back into a closed position when there is no pressure in the main control line by a pressure in a housing interior that is always aerated. By interposing the storage chamber aeration valve, the aeration of the second storage chamber is also achieved in a short time, similarly to the aeration of the retraction chamber explained above.

BRIEF DESCRIPTION OF THE DRAWINGS

The invention is described in more detail hereinafter with reference to exemplary embodiments shown in the figures, in which.

DETAILED DESCRIPTION OF THE INVENTION

Figure 1:
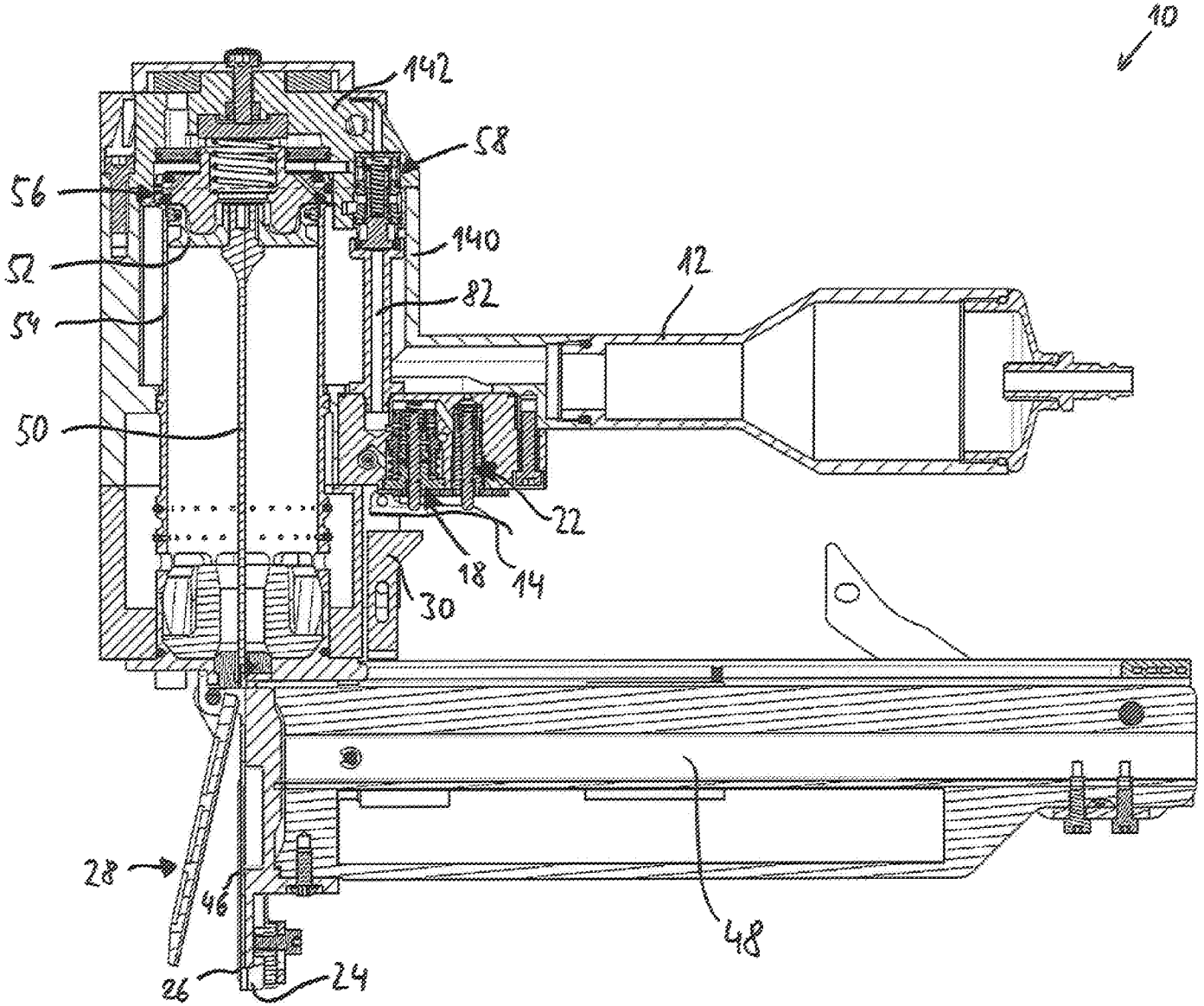
FIG. 1 illustrates partial cross-section view of an embodiment of a compressed air nailer.

Initially with reference to FIG. 1 an overview of the design of a compressed air nailer 10 according to the invention is provided. The compressed air nailer 10 has a lower housing part 140 with a handle 12. The lower housing part 140 is closed upwardly by a housing cap 142.

A control valve arrangement is arranged on the handle 12 with a trigger valve 22 which is assigned to or associated with a trigger 14 and a placing sensor valve 18 which is assigned to or associated with a placing sensor 24. The placing sensor 24 protrudes downwardly over the mouth 26 of an outlet tool 28 by a few millimetres. If the compressed air nailer 10 is placed onto a workpiece, the placing sensor 24 is displaced upwardly counter to the force of a spring, not shown, until it terminates flush or virtually flush with the mouth 26. A slider 30 which is a continuation of the placing sensor 24 or connected to the placing sensor 24 always moves together with the placing sensor 24. In particular, it follows the movement thereof upwardly relative to the housing when the compressed air nailer 10 is placed onto a workpiece until it actuates the placing sensor valve 18.

The outlet tool 28 has a receiver 46, in each case a fastening means being supplied thereto from a magazine 48. From this position inside the receiver 46 the fastening means—for example a nail, a tack or a staple—is driven in by a driving tappet 50 which is connected to a working piston 52 of the compressed air nailer 10. To this end, the working piston 52 is guided in a working cylinder 54. Above the working cylinder 54 and sealingly closing this working cylinder, a main valve 56 is arranged, to the right thereof being a pilot valve 58 which controls the main valve 56. Details of these elements and the function associated therewith are described with reference to the detailed enlargement of FIG. 2.

Figure 2:
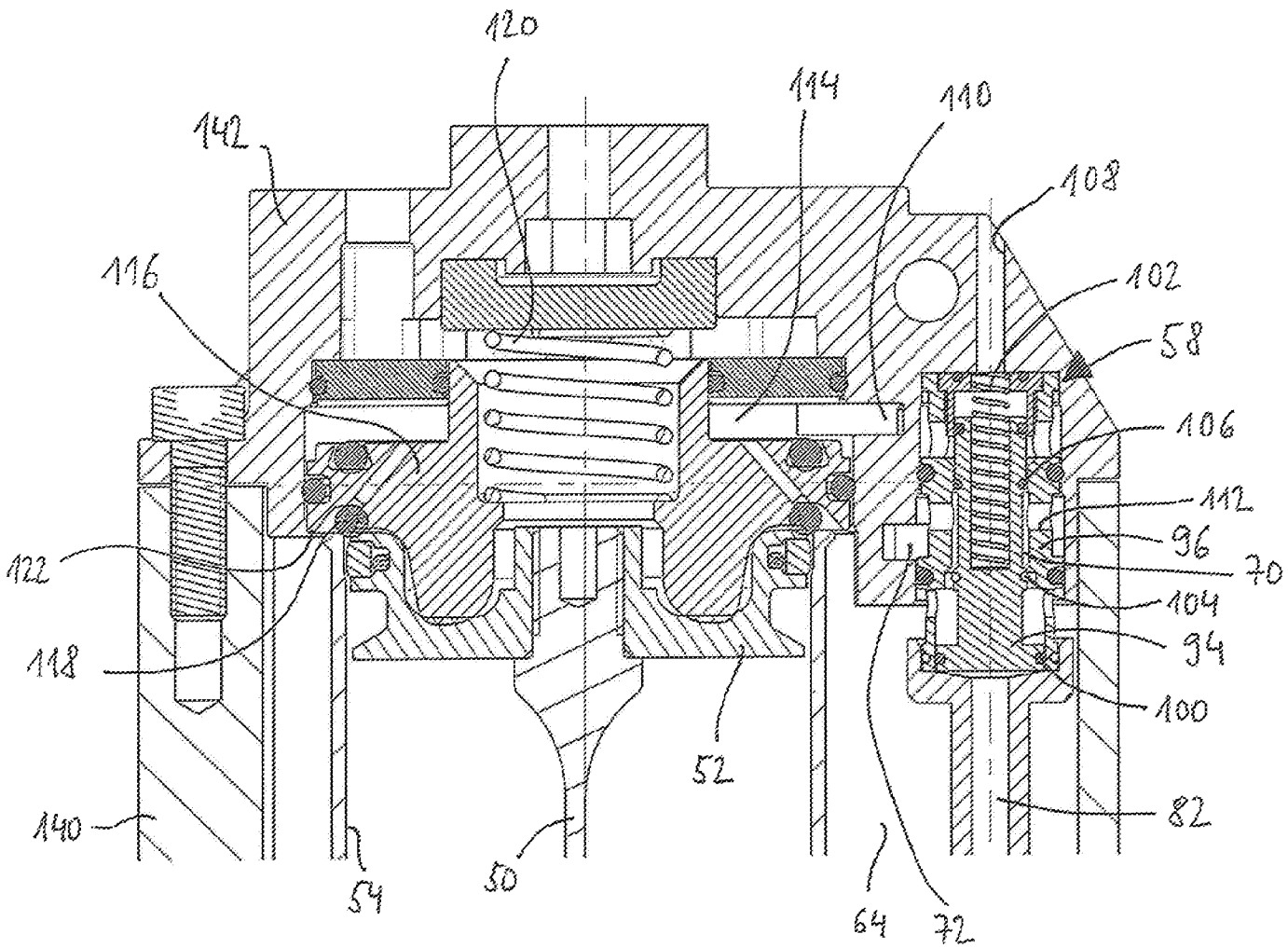
FIG. 2 illustrates an enlarged view of an embodiment of a main valve and a pilot valve of the compressed air nailer of FIG. 1.

In FIG. 2, individual elements of the compressed air nailer 10 which are arranged in FIG. 1 above the housing cap 142 are omitted. The pilot valve 58 may be easily identified. The pilot valve has a control piston 94 which is guided in a guide sleeve 96. The lower end of the control piston 94 is sealed by a lower O-ring 100 relative to the guide sleeve 96. In the initial state of the compressed air nailer 10 a main control line 82, which is connected to a working volume of the pilot valve 58, is deaerated and the control piston 94 is located in the lower position shown. In this position, the control piston is retained by the force of a spring 102.

The control piston 94 has in addition to the lower O-ring 100 a central O-ring 104 and an upper O-ring 106. In the lower position of the control piston 94 shown, the upper O-ring 106 seals the control piston 94 relative to the guide sleeve 96 and closes a connection with a deaeration opening 108 which is connected to the external air. The central O-ring 104 is not sealed so that a control line 110 is connected to the housing interior 64 via a radial bore 112 in the guide sleeve 96 and the annular gap 70 between the control piston 94 and the guide sleeve 96 past the central O-ring 104. The control line 110 is connected to the space 72 which discharges into the radial bore 112 via a connection, not visible in the cutting plane shown. The housing interior 64 in the initial state of the compressed air nailer 10 is aerated, i.e. connected to a compressed air connection, not shown, and at operating pressure.

The control line 110 is connected to a space 114 above a main valve actuating member 116 of the main valve 56, so that the main valve actuating member 116 is acted upon downwardly by a force and seals the upper edge of the working cylinder 54 by means of an O-ring 118 relative to the housing interior 64. Additionally, the main valve actuating member 116 is acted upon by a spring 120 with a force in the direction of the position shown, closing the working cylinder 54.

A driving process is triggered by the aeration of the main control line 82 by the control piston 94 being displaced upwardly, so that the central O-ring 104 is sealed and the upper O-ring 106 is no longer sealed. As a result, the connection of the control line 110 to the housing interior 64 is blocked and a connection is produced between the control line 110 and a deaeration opening, not shown. The space 114 above the main valve actuating member 116 is deaerated via the deaeration opening and the main valve actuating member 116 is displaced upwardly counter to the force of the spring 120 by the pressure which is present on its lower outer annular surface 122 and which prevails in the housing interior 64. As a result, compressed air flows out of the housing interior 64 into the working cylinder 54 above the working piston 52 and drives the working piston 52 downwardly. With this downward movement, the driving tappet 50 connected to the working piston 52 drives in a fastening means.

The cooperation of the control valve arrangement with the safety valve arrangement is initially described with reference to the pneumatics circuit diagram of FIG. 3. This shows, top left, the main control line 82 which in the exemplary embodiment leads to the pilot valve 58. The safety valve arrangement 16 is located to the right thereof in a dotted rectangle. The rectangle further to the right and also shown in dotted lines combines the placing sensor valve 18 and the trigger valve 22 to form the control valve arrangement 20.

The trigger valve 22 actuated by the trigger 14 has a first inlet 32 which is connected to the housing interior 64. A second inlet 34 of the trigger valve 22 is connected to the external air. The outlet 36 of the trigger valve 22 connected to the second inlet 34, in the unactuated position of the trigger valve 22 shown, is connected via a line 38 to a first inlet 40 of the placing sensor valve 18. The second inlet 42 of the placing sensor valve 18 is connected to the external air. In the unactuated position shown of the placing sensor valve 18, the outlet 44 of the placing sensor valve 18 is connected to the second inlet 42 of the placing sensor valve 18.

The safety valve arrangement 16 has a first control space 60, a second control space 62, a first outlet 66 and a second outlet 68. Moreover, the safety valve arrangement 16 has a first inlet 74, a second inlet 76, a third inlet 78 and a fourth inlet 80. The only actuating member 98 of the safety valve arrangement 16 is displaceable from the open position shown into a locked position.

The first inlet 74 of the safety valve arrangement 16 is connected via a line 124 to the outlet 44 of the placing sensor valve 18. The first outlet 66 of the safety valve arrangement 16 is connected to the main control line 82, and the second inlet 76 of the safety valve arrangement 16 is connected to the external air. In the open position shown of the safety valve arrangement, the first inlet 74 is connected to the first outlet 66, so that a connection is present between the main control line 82 and the control valve arrangement 20.

The third inlet 78 of the safety valve arrangement 16 is connected via a line 126, in which a non-return valve 128 is arranged, to the outlet 44 of the placing sensor valve 18. The fourth inlet 80 of the safety valve arrangement 16 is connected to the external air. The second outlet 68 of the safety valve arrangement 16 is connected to a storage chamber 130 and to the second control space 62. Moreover, a connection exists between the second control space 62 or respectively, the second outlet 68 of the safety valve arrangement and a throttle 132, via which the storage chamber 130 is deaerated. In the open position of the safety valve arrangement 16 shown, the third inlet 78 is connected to the second outlet 68 so that an aeration of the second control space 62 is possible via the placing sensor valve 18. The first control space 60 is connected to the outlet 36 of the trigger valve 22 via a line shown in dashed lines.

Figure 3:
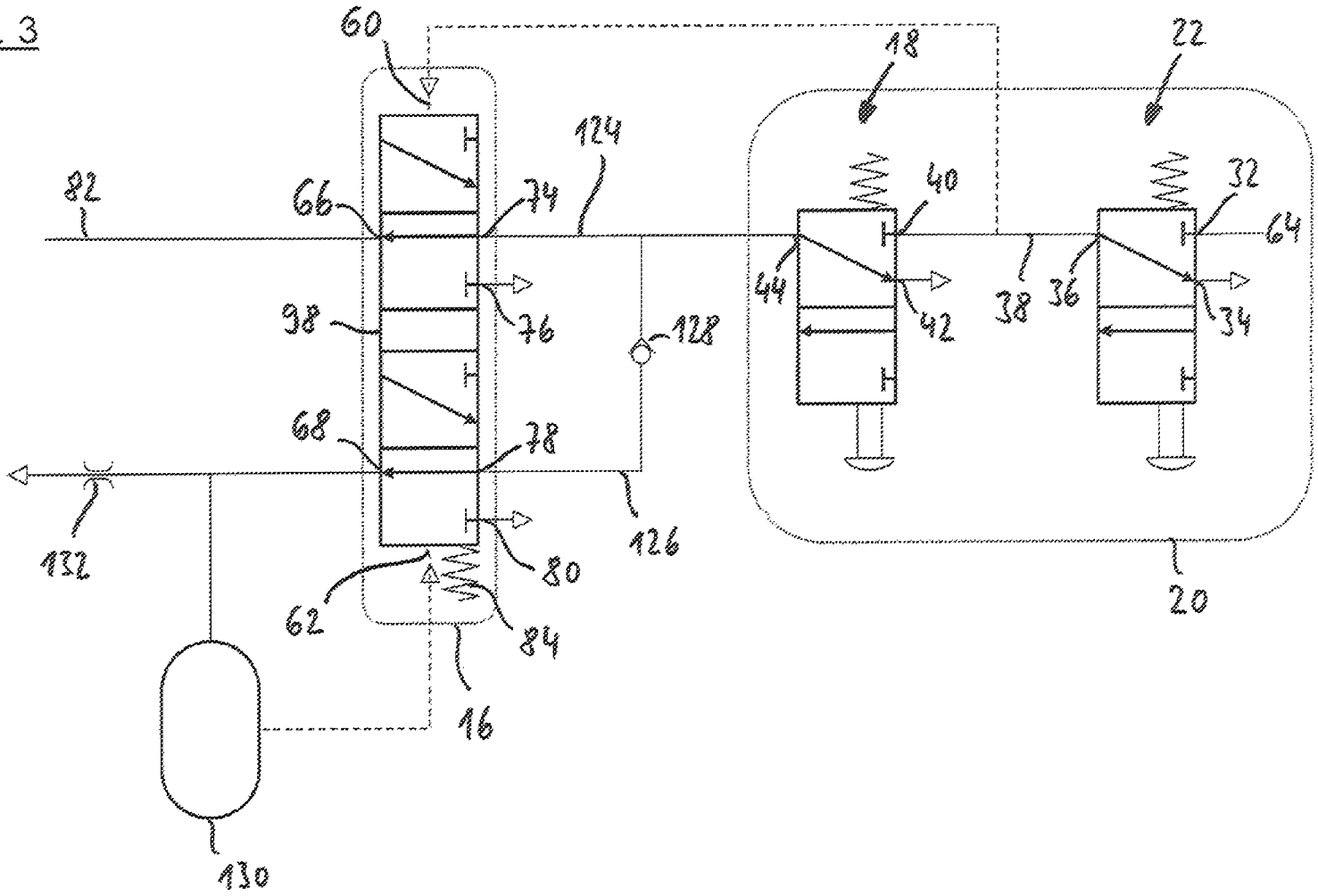
FIG. 3 illustrates a schematic depiction of an embodiment of a pneumatics circuit diagram of the control and safety valve arrangement of the compressed air nailer of FIG. 1.

If starting from the basic state of FIG. 3 the trigger valve 22 is actuated first, the outlet 36 thereof is connected to the housing interior 64. As a result, the first control space 60 is aerated, whereby the actuating member 98 of the safety valve arrangement 16 is displaced into the locked position. As a result, the connection between the third inlet 78 and the second outlet 68 of the safety valve arrangement is interrupted so that a subsequent actuation of the placing sensor valve 18 may not aerate the second control space 62. Moreover, the first outlet 66 is separated from the first inlet 74 of the safety valve arrangement 16, so that the control valve arrangement 20 may no longer act on the main control line 82 and a driving process may not be triggered.

As an additional safety measure, the main control line 82 is deaerated by the connection produced in the locked position between the first outlet 66 and the second inlet 76 of the safety valve arrangement 16. If a pressure prevails in the storage chamber 130 which is different from the external air, this storage chamber is deaerated at the same time via the connection produced by the safety valve arrangement 16 between the second outlet 68 and the fourth inlet 80.

The triggering of a driving process is then only possible again when the trigger valve 22 is transferred into its unactuated position by releasing the trigger 14. At this moment, namely via the connection produced between the outlet 36 and the second inlet 34 of the trigger valve 22, the first control space 60 is deaerated, so that the actuating member 98 reaches its open position again by the force of the spring 84.

In order to trigger a first driving process starting from the initial state, the placing sensor valve 18 has to be actuated first. As a result, a connection is produced between the first inlet 40 and the outlet 44 of the placing sensor valve 18. With a subsequent actuation of the trigger valve 22, then a connection is produced between the first inlet 32 thereof and the outlet 36 thereof, so that compressed air flows into the first control space 60 via the line 38 and at the same time into the second control space 62 via the actuated placing sensor valve 18, the non-return valve 128 and the line 126, and the connection present in the open position between the third inlet 78 and the second outlet 68 of the safety valve arrangement 16. Thus at the same time the forces acting by the pressures in these two control spaces act on the actuating member 98, which in cooperation with the spring 84 leads to the actuating member 98 remaining in the open position shown. Therefore, the aeration of the line 124 effects at the same time an aeration of the main control line 82 and a driving process is triggered.

If after this driving process the device is removed from the workpiece, the placing sensor valve 18 again reaches its unactuated position shown. Due to the non-return valve 128 the pressure prevailing in the storage chamber 130 and the second control space 62 is initially maintained so that the actuating member 98 remains in its open position. The pressure in the second control space 62 and the storage chamber 130 slowly reduces via the throttle 132, however, until it finally drops below a pressure threshold. At this moment, the actuating member 98 is displaced into its locked position due to the pressure which also prevails in the first control space 60 when the trigger valve 22 is permanently actuated. From this point in time, therefore, further contact triggering is not possible.

Structural details are described in more detail with reference to FIGS. 4 to 9. In each of these figures is identified the trigger 14, which is pivotably mounted about a pivot axis 86, and the slider 30 of the placing sensor 24. This slider may move up and down when the placing sensor valve 24 is actuated, in order to displace the valve pin 88 of the placing sensor valve 18 counter to the force of a spring 134 into an actuated position. The trigger valve 22 also has a valve pin 90 which may be displaced counter to the force of a spring 92 into an actuated position. This occurs directly by the cooperation with the trigger 14.

Figure 4:
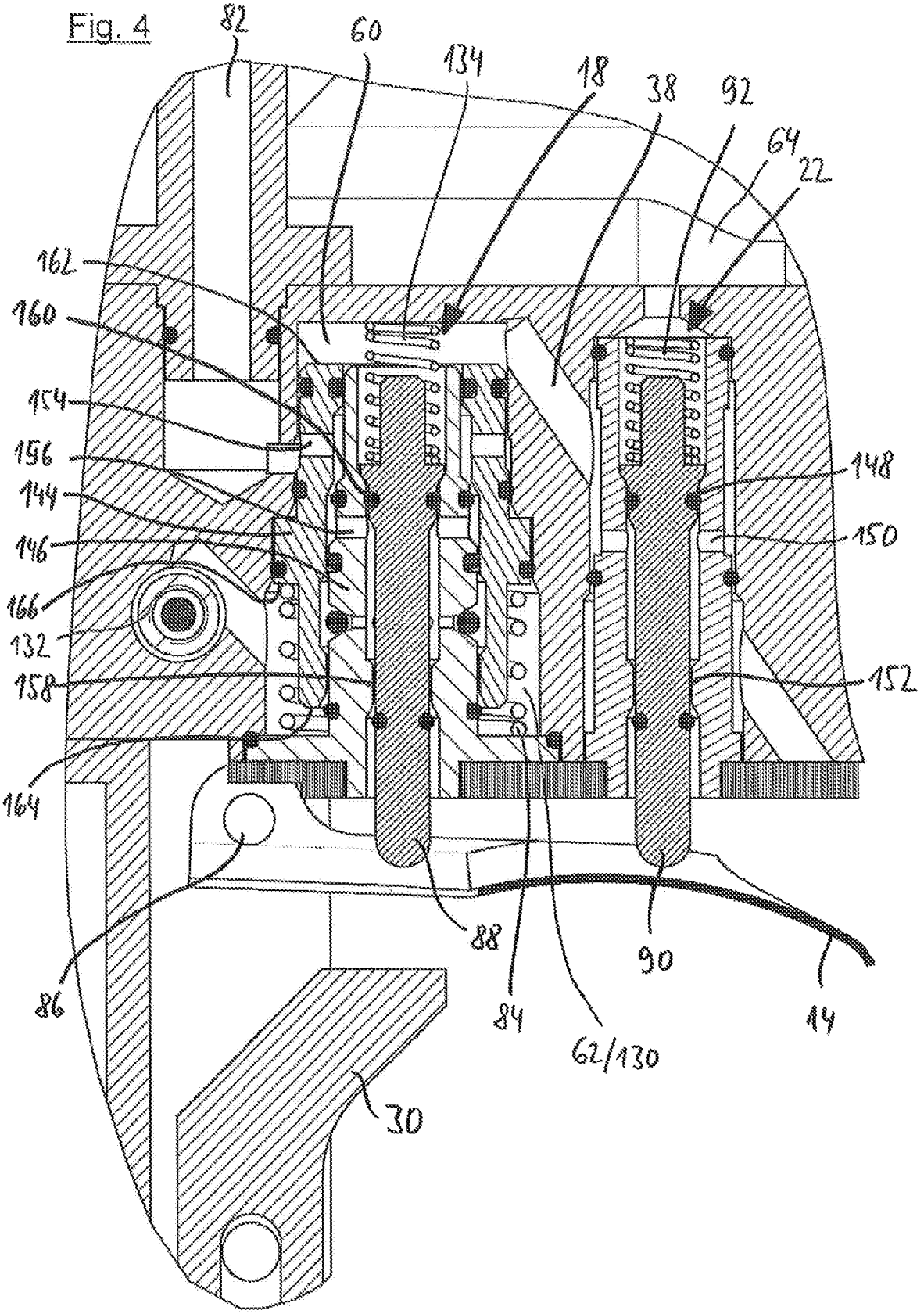
FIG. 4 illustrates an enlarged view of the control and safety valve arrangement of the compressed air nailer of FIG. 1 in an operating state.

FIG. 4 shows the initial state in which the placing sensor valve 18 and the trigger valve 22 are shown in each case in their unactuated position. The safety valve arrangement 16 has as an actuating member 98 a locking sleeve 144 which surrounds a valve sleeve 146 of the placing sensor valve 18.

The housing interior 64 which is under pressure is blocked by the O-ring 148 from the line 38 leading to an inlet of the placing sensor valve 18. Instead, the line 38 is connected to the external air via the radial bore 150 and the annular gap 152 of the trigger valve 22.

The main control line 82 is also connected to the external air and namely via a radial bore 154 in the locking sleeve 144, which is located in its open position, a radial bore 156 in the valve sleeve 146 and an annular gap 158 of the placing sensor valve 18. At the same time the radial bore 156 in the valve sleeve 146 and thus also the main control line 82 is blocked from the line 38 by the O-ring 160 of the placing sensor valve 18 which is sealed.

Above the locking sleeve 144 is located the first control space 60 which is connected to the line 38. The pressure in this first control space 60 acts via an annular surface 162 of the locking sleeve 144 onto the locking sleeve 144 and attempts to displace this locking sleeve in FIG. 4 downwardly into the locked position.

The second control space 62 is located below the locking sleeve 144 and acts thereon via two annular surfaces 164, 166 of the locking sleeve 144. The pressure in the second control space 62, therefore, attempts to displace the locking sleeve 144 into the open position shown, i.e. upwardly in FIG. 4. The spring 84 also exerts a force in this particular direction onto the locking sleeve 144.

The second control space 62 has a relatively large volume and, therefore, is at the same time a storage chamber 130. Via the throttle 132, the second control space 62 or respectively, the storage chamber 130 is connected to the external air.

Figure 5:
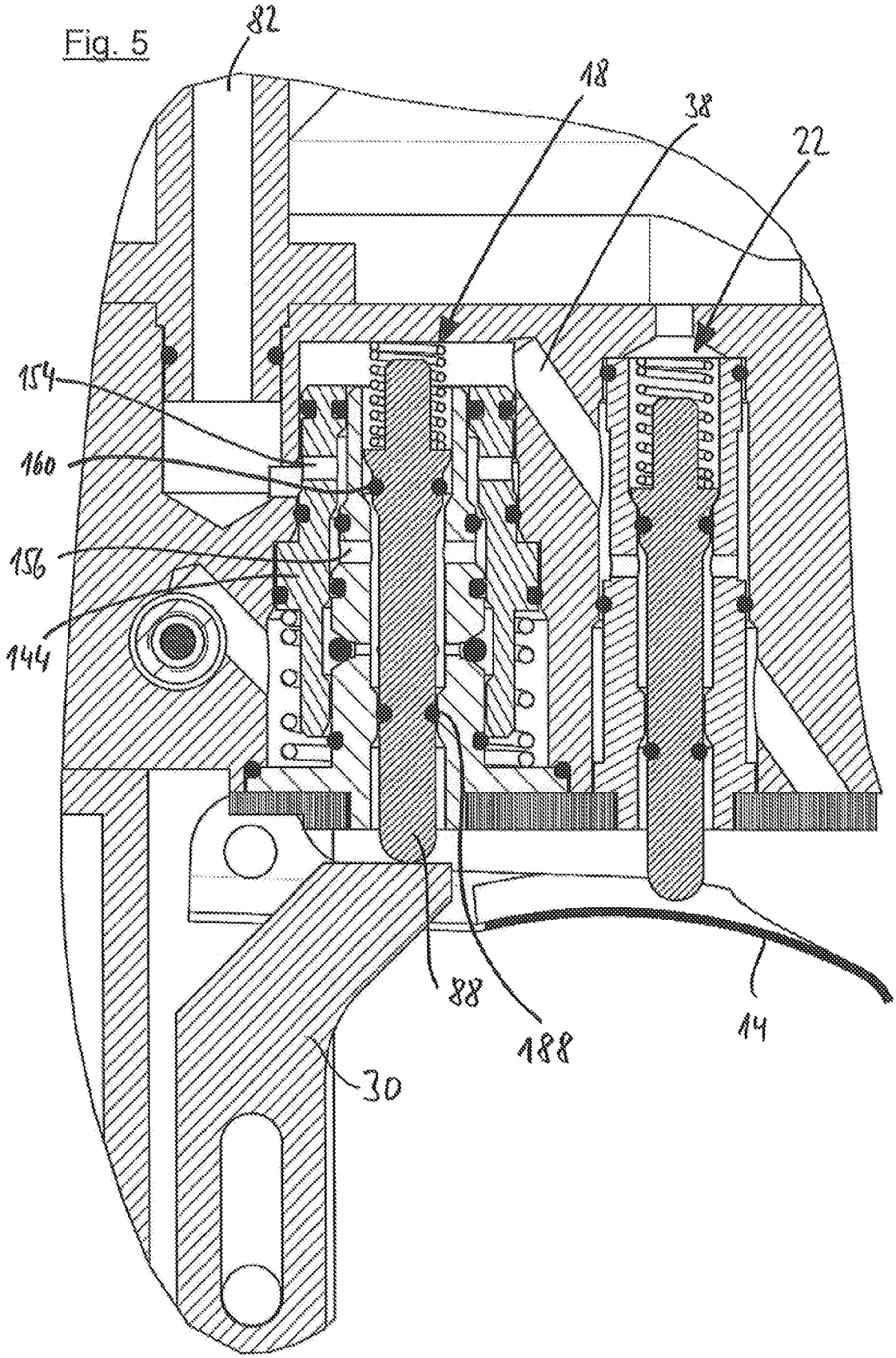
FIG. 5 illustrates an enlarged view of the control and safety valve arrangement of the compressed air nailer of FIG. 1 in another operating state.

FIG. 5 shows the arrangement of FIG. 4 after placing the compressed air nailer 10 onto a workpiece. For improved clarity, in FIGS. 5 to 9 only the elements discussed relative to these figures are provided with reference numerals. In FIG. 5 it is identified that the slider 30 of the placing sensor 24 is displaced upwardly and has moved the valve pin 88 upwardly, whereby the placing sensor valve 18 has been displaced into the actuated position. By this measure the O-ring 160 is no longer sealed so that now the line 38 is connected to the main control line 82 via the placing sensor valve 18 and the radial bore 156 thereof and the radial bore 154 in the locking sleeve 144. At the same time, the O-ring 188 seals the lines 124, 126 relative to the external air. Since the trigger valve 22 is still in its unactuated position, the line 38 is deaerated so that the actuation of the placing sensor valve 18 has no further effect.

Figure 6:
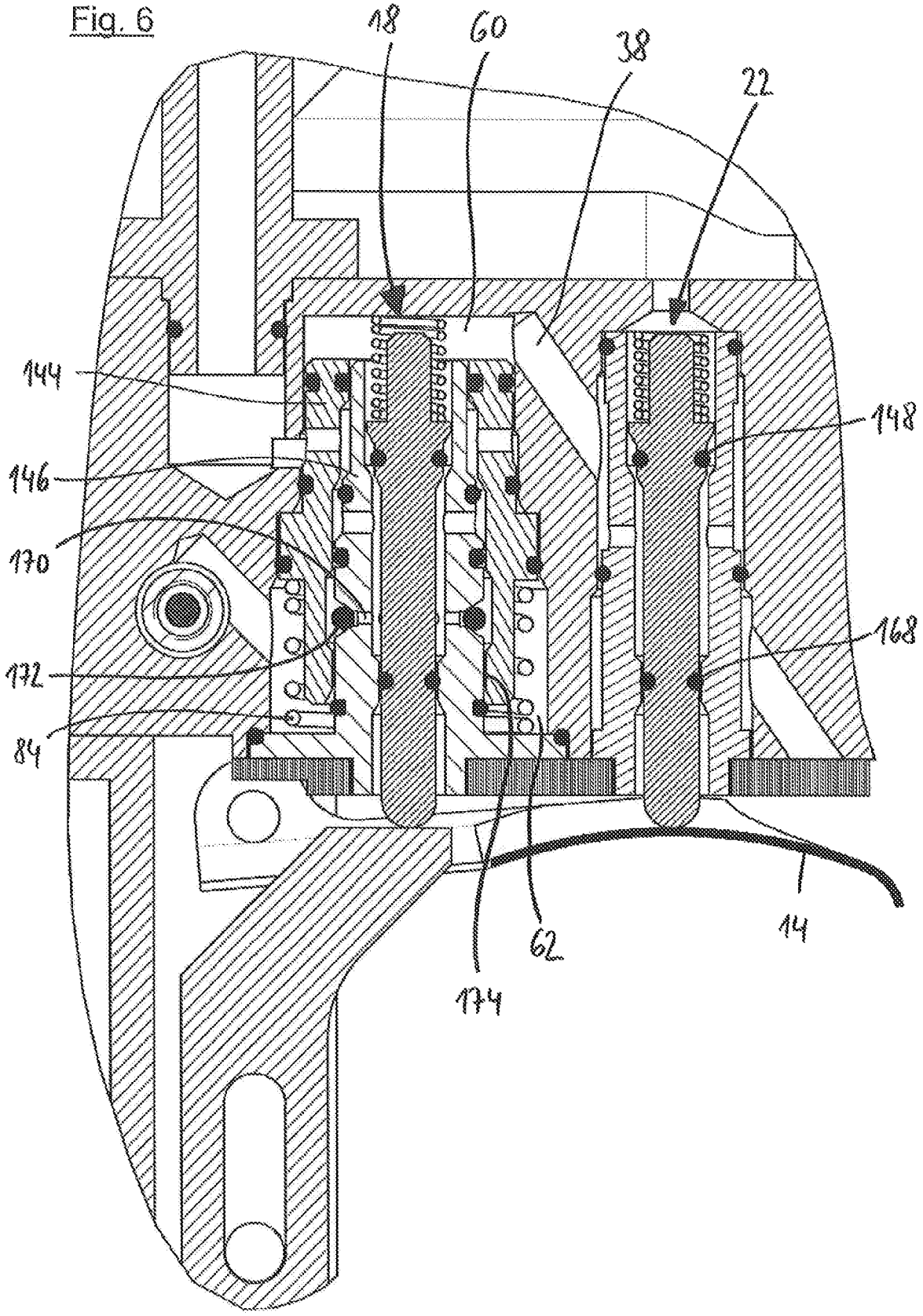
FIG. 6 illustrates an enlarged view of the control and safety valve arrangement of the compressed air nailer of FIG. 1 in another operating state.

If subsequently the trigger 14 and thus the trigger valve 22 is actuated, as shown in FIG. 6, the O-ring 148 is no longer sealed so that the line 38 is aerated. At the same time the O-ring 168 seals this line 38 relative to the external air. The first control space 60 connected to the line 38 is also aerated.

The valve sleeve 146 has a radial bore 170 and an O-ring 172 closing this radial bore. The radial bore 170 and the O-ring 172 form together the non-return valve 128. Via this non-return valve 128 in the situation shown in FIG. 6, the second control space 62 is also aerated via the line 38. To this end, the air flows through the non-return valve 128 and further through an annular gap 174 formed between the valve sleeve 146 and the locking sleeve 144. This aeration of the second control space 62 takes place approximately at the same time as the aeration of the first control space 60 so that the forces exerted by these two control spaces 60, 62 onto the locking sleeve 144 are effective approximately at the same time. A suitable dimensioning of the aforementioned annular surfaces 160, 164, 166 (see FIG. 4) and the force of the spring 84 leads to the locking sleeve 144 remaining in its open position. The aeration of the line 38 has the further result that the main control line 82 is aerated and a driving process is triggered.

Figure 7:
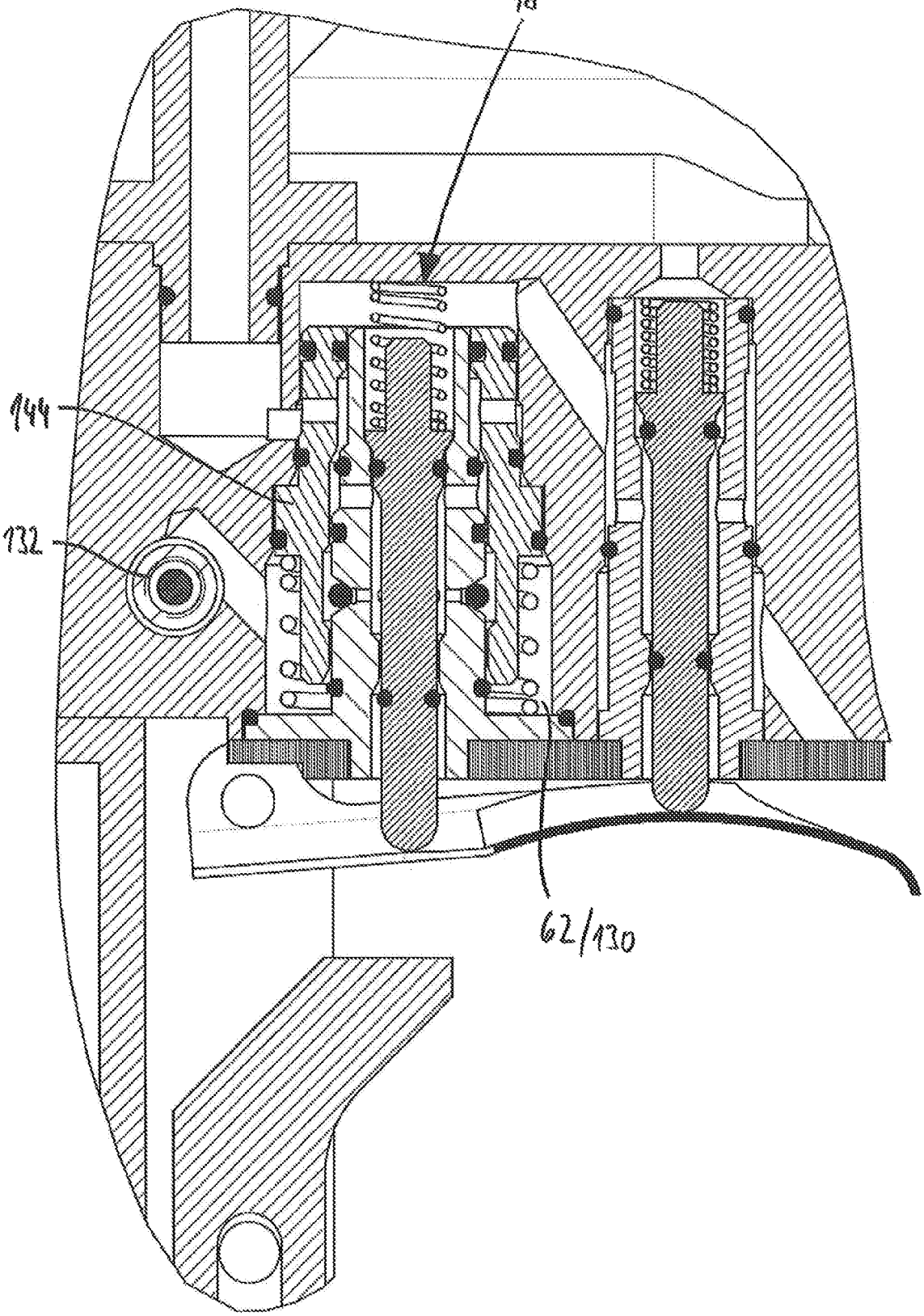
FIG. 7 illustrates an enlarged view of the control and safety valve arrangement of the compressed air nailer of FIG. 1 in another operating state.

If the device is subsequently removed from the workpiece and the placing sensor 24 is relieved of load, the placing sensor valve 18 moves back into its unactuated position. This is shown in FIG. 7. For a short time after the previous driving process a sufficiently high pressure is present in the second storage chamber 62 in order to retain the locking sleeve 144 in its open position. In this time period, by further actuation of the placing sensor valve 24 a contact triggering may be carried out at any time, which simultaneously leads to a replenishment of the pressure in the second control space 62 on the path already outlined, so that the time window opens up again for further contact triggering.

Figure 8:
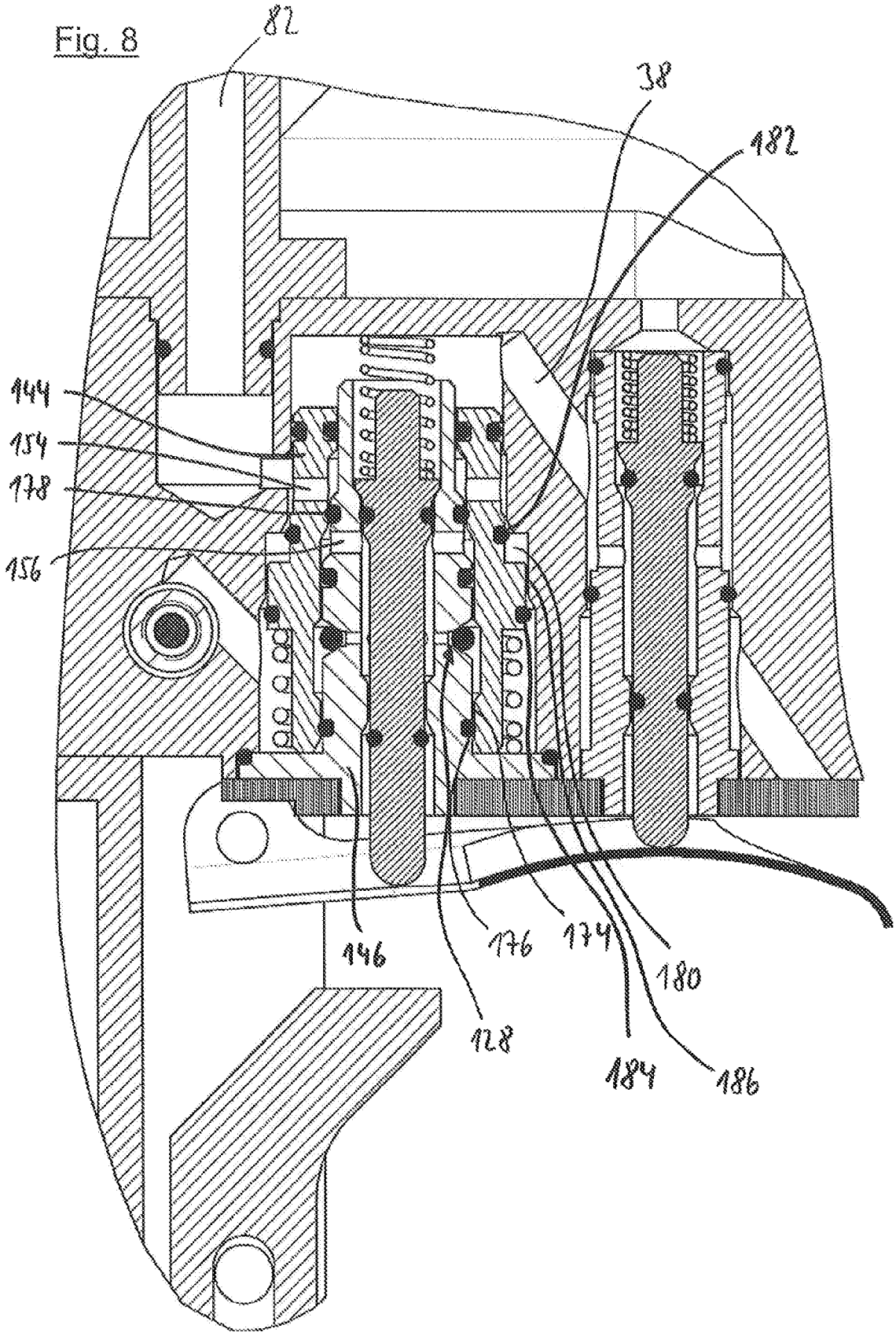
FIG. 8 illustrates an enlarged view of the control and safety valve arrangement of the compressed air nailer of FIG. 1 in another operating state.

If, however, no further contact triggering takes place, the pressure slowly drops in the storage chamber 130 and the second control space 62 by deaeration via the throttle 132 until the locking sleeve 144 is displaced downwardly into its locked position, as shown in FIG. 8. As a result, the annular gap 174 is sealed by the O-ring 176 arranged on the valve sleeve 146, so that an aeration of the second control space 62 via the non-return valve 128 is no longer possible. At the same time the O-ring 178 which is also arranged on the valve sleeve 146 closes an annular gap between the valve sleeve 146 and the locking sleeve 144 via which previously a connection was present between the radial bore 156 of the valve sleeve 146 and the radial bore 154 of the locking sleeve 144. As a result, the main control line 82 is blocked from the line 38.

Moreover, the space denoted by 180 in FIG. 8 is connected via a bore, which is not visible, to the external air. Due to the two O-rings 182, 184 of the locking sleeve 144, which are not sealed, this leads to a deaeration of the main control line 82 via the radial bore 154 of the locking sleeve 144 and of the second control space 62 which is now connected to the space 180 via the annular gap 186. The locking sleeve 144 is now located in its locked position shown in FIG. 8 as long as the trigger 14 remains actuated.

Figure 9:
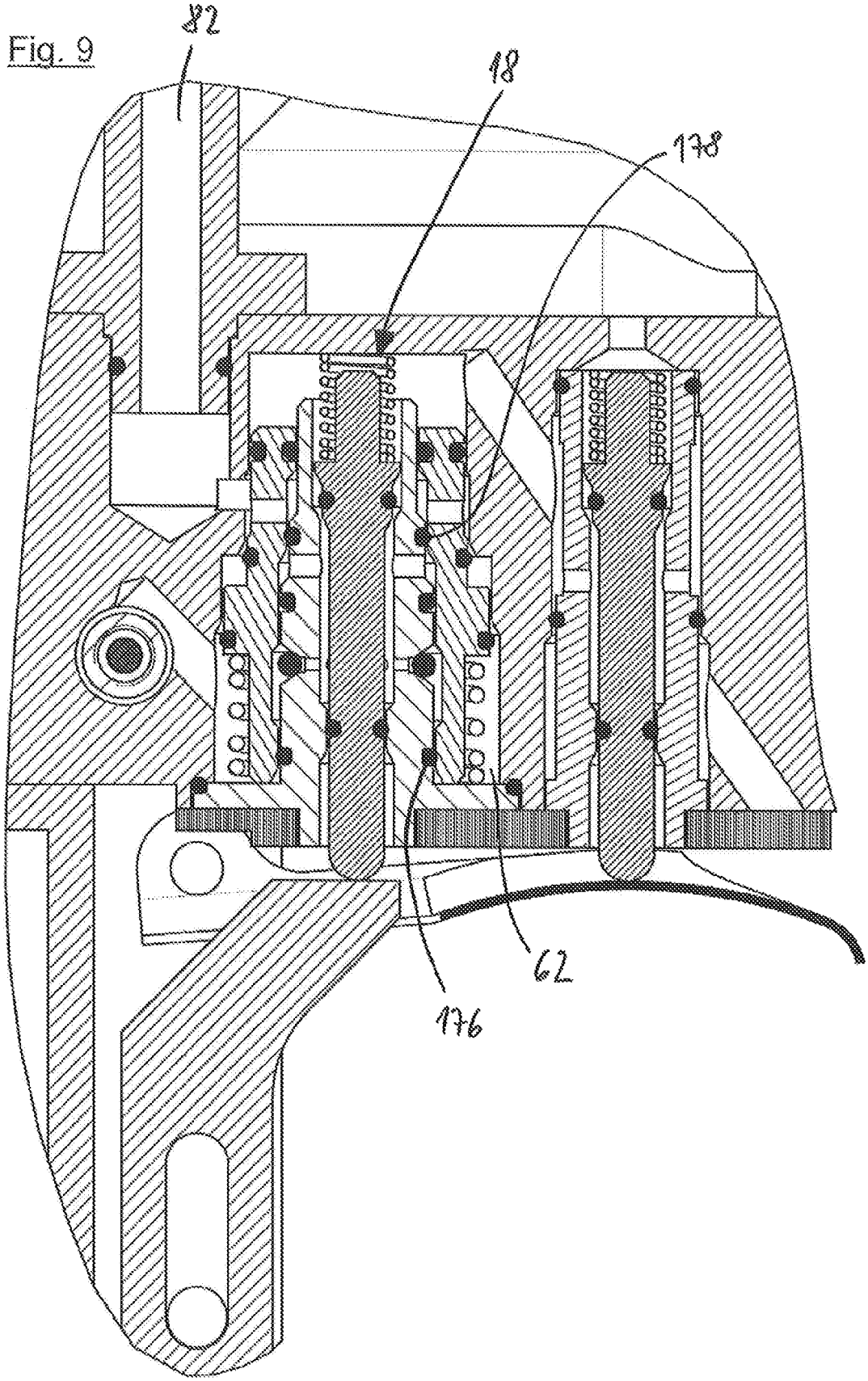
FIG. 9 illustrates an enlarged view of the control and safety valve arrangement of the compressed air nailer of FIG. 1 in still another operating state.

If, as shown in FIG. 9, the placing sensor 24 and thus the placing sensor valve 18 are then actuated again, this results in neither an aeration of the main control line 82 nor an aeration of the second control space 62 due to the further O-rings 176 and 178 which are sealed.

A further compressed air nailer 10 is explained with reference to FIGS. 10 and 11. Essential elements of the further compressed air nailer 10 correspond to the compressed air nailer 10 from FIGS. 1 to 9. These elements are provided with the same reference numerals as there and will not be explained again. This includes in particular the control valve arrangement 20 and the safety valve arrangement 16. Differences exist regarding the control of the pressure in the second control space 62.

Figure 10:
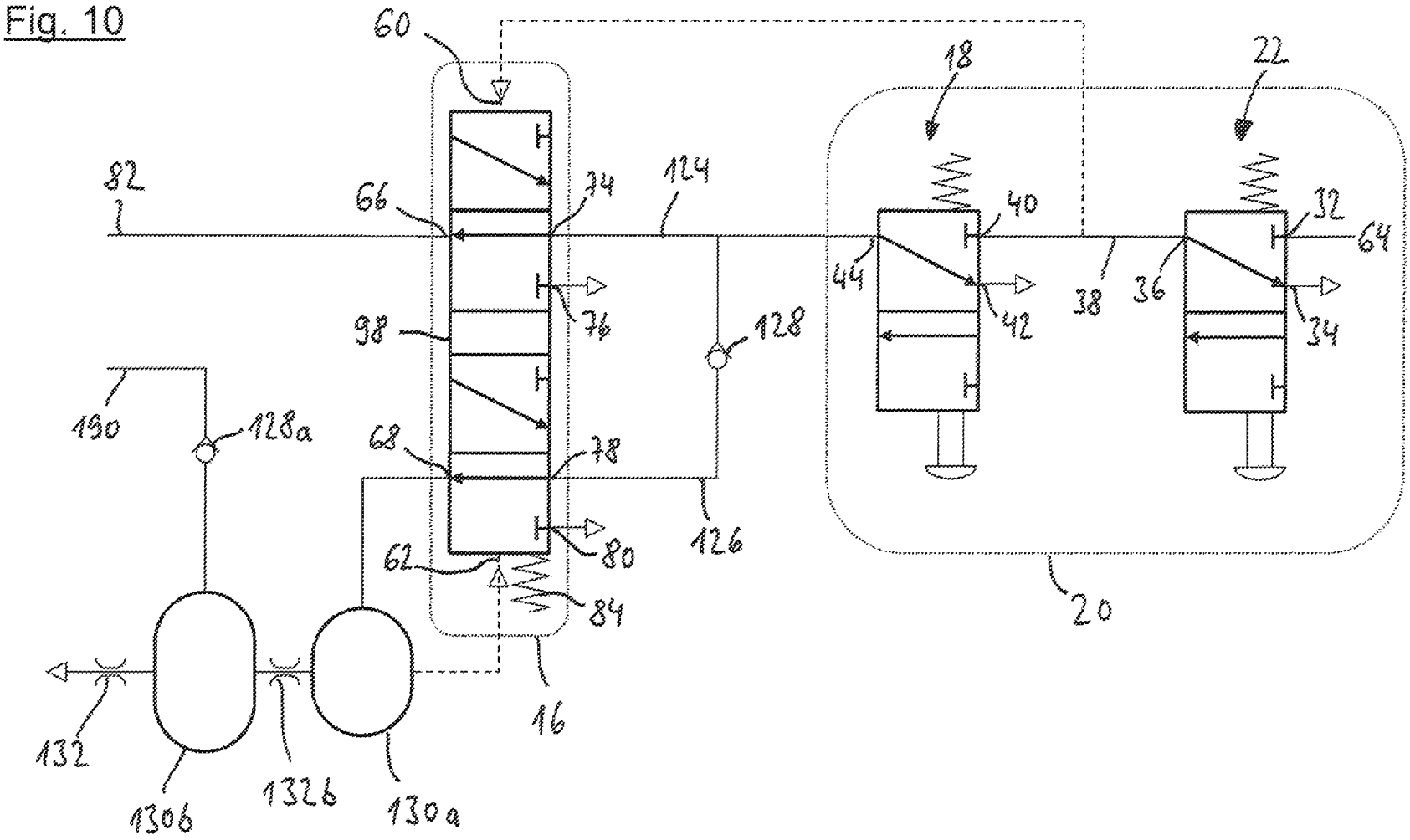
FIG. 10 illustrates a schematic depiction of a pneumatics circuit diagram of another embodiment of a compressed air nailer.

As clarified in FIG. 10, there is now, instead of a single storage chamber 130, a first storage chamber 130*a* and a second storage chamber 130*b* which are connected to each other via a further throttle 132*b*. The second storage chamber 130*b* is continuously connected to external air via a throttle 132. Moreover, a connection indicated by the line 190 between the second storage chamber 130*b* and a retraction chamber 192 (see FIG. 11) of the compressed air nailer 10 exists. A further non-return valve 128*a* is arranged in this connection.

The volumes of the two storage chambers 130*a* and 130*b* can have different sizes, even when this is not necessary. In particular, the volume of the first storage chamber 130*a* can be selected to be smaller than the volume of the second storage chamber 130*b*. The opening cross section of the further throttle 132*b* can deviate from the opening cross section of the throttle 132, even when this is not necessary. In particular, the opening cross section of the further throttle 132*b* can be larger than the opening cross section of the throttle 132. The further throttle 132*b* and/or the throttle 132 can in particular each be formed by a small bore with a diameter in the range of 0.1 mm to 1 mm.

If the trigger valve 22 and the placing sensor valve 18 are actuated together, this leads to a rapid increase in pressure in the second control space 62, in this exemplary embodiment by feeding air into the first storage chamber 130*a* via the second outlet 68 of the safety valve arrangement 16. Only a small part of this inflow into the first storage chamber 130*a* flows into the second storage chamber 130*b* via the further throttle 132*b*. Therefore, the safety valve arrangement 16 remains in its open position shown in FIG. 10, and a driving process is triggered. As a result of the driving process, the second storage chamber 130*b* is aerated via the further non-return valve 128*a* through the connection 190 to the retraction chamber 192. Due to the exchange of air between the two storage chambers 130*a*, 130*b* via the further throttle 132*b*, the pressures in the two storage chambers 130*a*, 130*b* quickly equalise as a result. If no further driving process is triggered, the pressure in both storage chambers 130*a*, 130*b* subsequently slowly reduces due to the deaeration via the throttle 132*b*.

Figure 11:
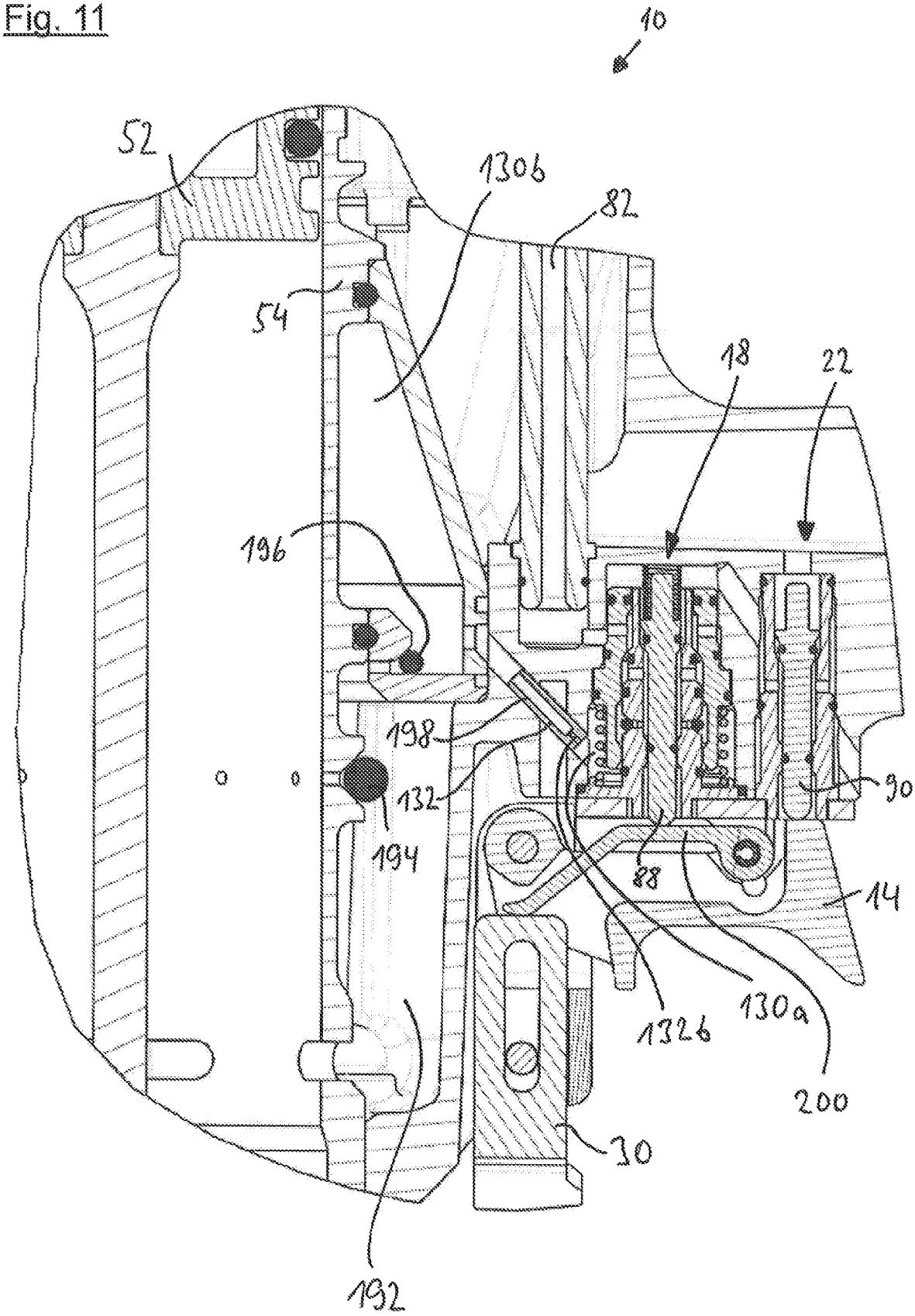
FIG. 11 illustrates a partial cross-sectional view of the compressed air nailer of FIG. 10.

In FIG. 11 it can be seen that the implementation of the first storage chamber 130*a* closely resembles that of the single storage chamber 130 in the exemplary embodiment from FIGS. 1 to 9. The retraction chamber 192 of the compressed air nailer 10 which is aerated via a non-return valve formed by an O-ring 194 once the working cylinder 52 is driven sufficiently downwards is additionally represented. The further non-return valve 128*a* is formed by an O-ring 196 which seals a connection between the second storage chamber 130*b* and the retraction chamber 192. The second storage chamber 130*b* has a clearly larger volume than the first storage chamber 130*a*. It nearly corresponds to the volume of the retraction chamber 192. The second storage chamber 130*b* is arranged annularly around the working cylinder 54.

Between the first storage chamber 130*a* and the second storage chamber 130*b*, a sleeve 198 that is arranged diagonally is inserted and forms at one end a further throttle 132*b* that is formed by a small longitudinal bore. In addition, the sleeve 198 has a small cross bore which connects the interior of the sleeve 198 to external air. This small cross bore forms the throttle 132.

A further difference to the exemplary embodiment from FIGS. 1 to 9 is that, according to FIG. 11, the placing sensor 24 does not act directly on the valve pin 88 of the placing sensor valve 18 but rather acts via a rocker 200 that is pivotably mounted on the housing of the compressed air nailer 10.

Figure 12:
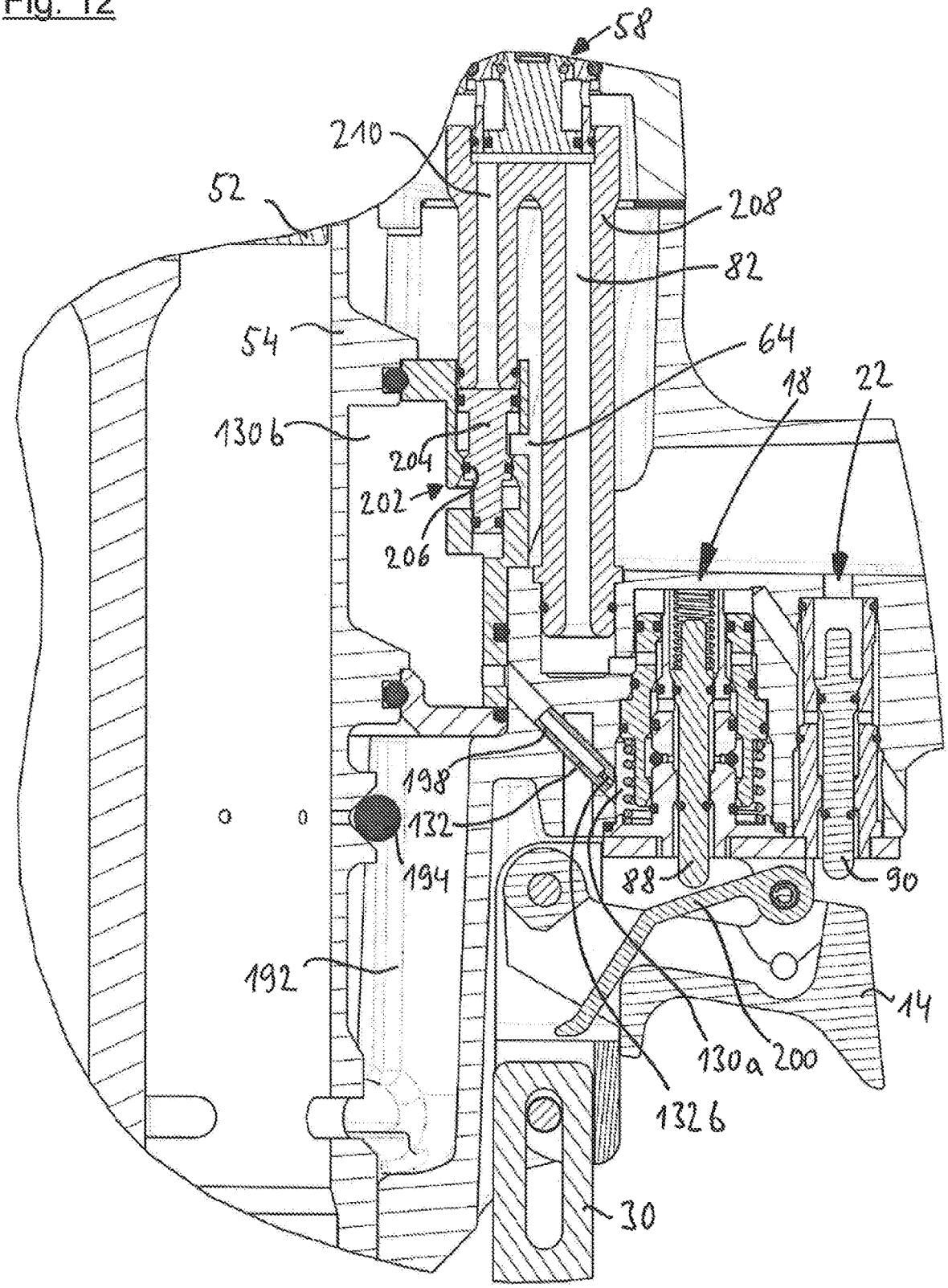
FIG. 12 illustrates a partial cross-sectional view of another embodiment of a compressed air nailer.

Yet another compressed air nailer 10 is explained with reference to FIGS. 12 and 13. Essential elements of this compressed air nailer 10 correspond to the compressed air nailer 10 from FIGS. 10 and 11. These elements are provided with the same reference numerals as there and will not be explained again. This includes in particular the control valve arrangement 20 and the safety valve arrangement 16 as well as the storage chamber 130 which is divided into a first storage chamber 130*a* and a second storage chamber 130*b*. Differences exist regarding the aeration of the second storage chamber 130*b*.

Unlike with the compressed air nailer 10 from FIGS. 10 and 11, the aeration of the second storage chamber 130*b* does not take place from the retraction chamber 192 via a non-return valve but rather via a special storage chamber aeration valve 202. This valve has an actuating member 204 which is displaceable between a closed position shown in FIG. 12 and an open position shown in FIG. 13. In the closed position, there is a sealing O-ring 206 which is arranged around the actuating member 204 and as a result blocks a connection between the housing interior 64 which is always aerated and the second storage chamber 130*b*.

A component 208 accommodating a part of the pilot valve 58 forms a part of the main control line 82 as well as a further control line 210 which is connected to the main control line 82 and via which the storage chamber aeration valve 202 is activated. The pressure prevailing in the further control line 210 thereby acts on a piston of the storage chamber aeration valve 202 formed by the actuating member 204.

Figure 13:
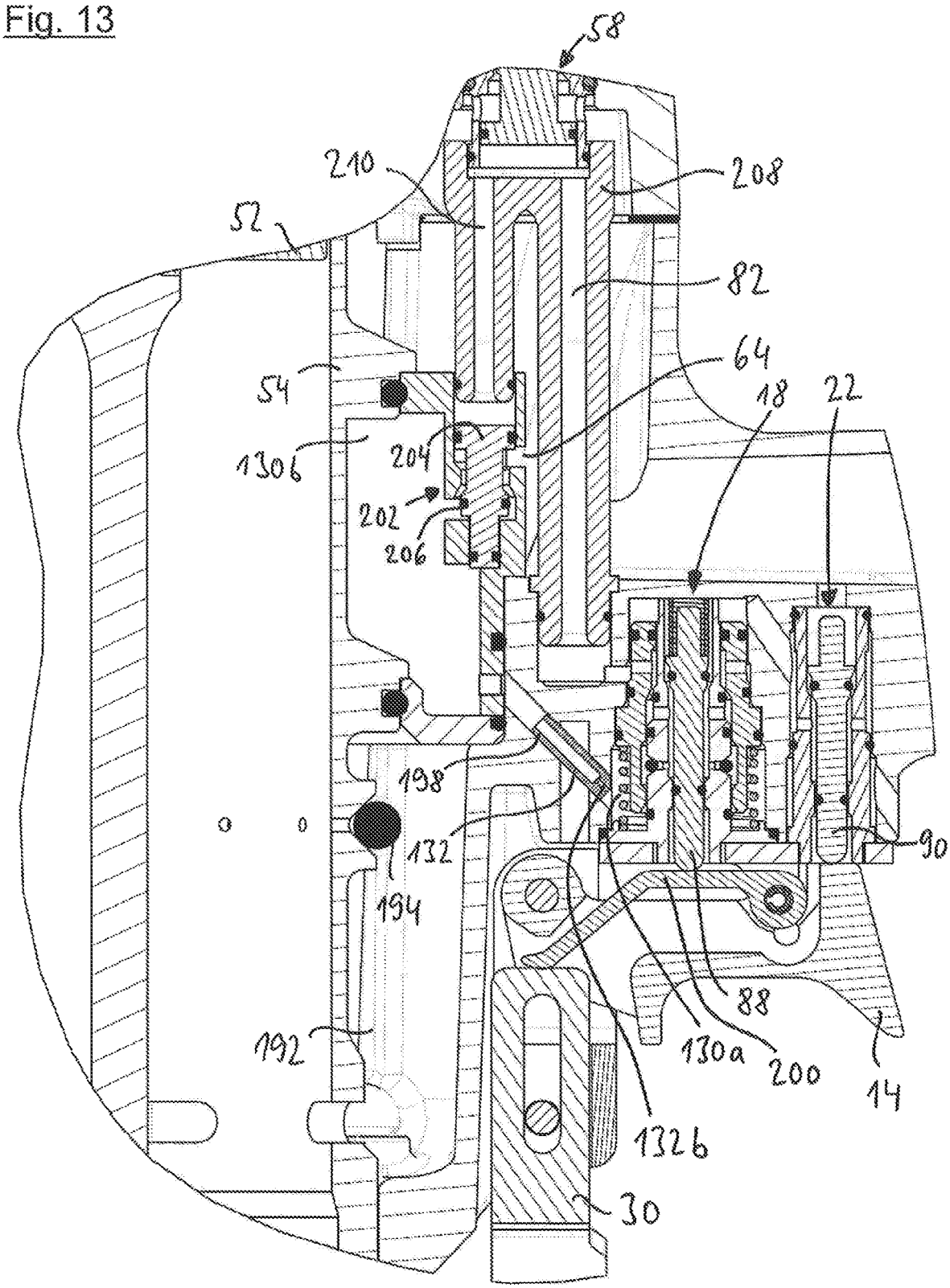
FIG. 13 illustrates the compressed air nailer from FIG. 12 in a different operating state.

If the main control line 82 is aerated through actuation of the control valve arrangement 20, as explained in the exemplary embodiment from FIGS. 1 to 9, this accordingly effects a displacement of the storage chamber aeration valve 202 into the open position which is shown in FIG. 13. The O-ring 206 moves out of the sealing position and the second storage chamber 130*b* is aerated from the housing interior 64.

Once the trigger valve 22 or the placing sensor valve 18 moves back into its respective unactuated position, the control line 124 (see FIG. 10) is deaerated which at the same times leads to a deaeration of the main control line 82 and of the further control line 210. As a result, the storage chamber aeration valve 202 falls back into its closed position and blocks the second storage chamber 130*b* from the housing interior 64. Subsequently, as in the exemplary embodiment from FIGS. 10 and 11, the two storage chambers 130*a*, 130*b* are slowly deaerated via the throttle 132.

LIST OF REFERENCE NUMERALS

10 Compressed air nailer
12 Handle
14 Trigger
16 Safety valve arrangement
18 Placing sensor valve
20 Control valve arrangement
22 Trigger valve
24 Placing sensor
26 Mouth
28 Outlet tool
30 Slider
32 First inlet of trigger valve
34 Second inlet of trigger valve
36 Outlet of trigger valve
38 Line
40 First inlet of placing sensor valve
42 Second inlet of placing sensor valve
44 Outlet of placing sensor valve
46 Receiver
48 Magazine
50 Driving tappet
52 Working piston
54 Working cylinder
56 Main valve
58 Pilot valve
60 First control space
62 Second control space
64 Housing interior
66 First outlet of safety valve arrangement
68 Second outlet of safety valve arrangement
70 Annular gap
72 Space
74 First inlet of safety valve arrangement
76 Second inlet of safety valve arrangement
78 Third inlet of safety valve arrangement
80 Fourth inlet of safety valve arrangement
82 Main control line
84 Spring
86 Pivot axis
88 Valve pin
90 Valve pin
92 Spring
94 Control piston
96 Guide sleeve
98 Actuating member
100 Lower O-ring
102 Spring
104 Central O-ring
106 Upper O-ring
108 Deaeration opening
110 Control line
112 Radial bore
114 Space
116 Main valve actuating member
118 O-ring
120 Spring
122 Annular surface
124 Line
126 Line
128 Non-return valve
128*a* Further non-return valve
130 Storage chamber
130*a* First storage chamber
130*b* Second storage chamber
132 Throttle
132*b* Further throttle
134 Spring
140 Lower housing part
142 Housing cap
144 Locking sleeve
146 Valve sleeve
148 O-ring
150 Radial bore of trigger valve
152 Annular gap of trigger valve
154 Radial bore of locking sleeve
156 Radial bore of valve sleeve
158 Annular gap of placing sensor valve
160 O-ring
162 Annular surface
164 Annular surface
166 Annular surface
168 O-ring
170 Radial bore of non-return valve
172 O-ring of non-return valve
174 Annular gap
176 O-ring
178 O-ring
180 Space
182 O-ring
184 O-ring
186 Annular gap
188 O-ring

190 Line
192 Retraction chamber
194 O-ring
196 O-ring
198 Sleeve
200 Rocker
202 Storage chamber aeration valve
204 Actuating member
206 O-ring
208 Component
210 Further control line

The invention claimed is:

1. A compressed air nailer comprising:

a working piston configured to be driven by compressed air during a driving process;

a driving tappet configured to connect to the working piston and configured to drive a fastener means when the driving process is triggered;

a trigger;

a placing sensor, wherein actuation of the trigger and the placing sensor aerate or deaerate a main control line to enable triggering of the driving process;

a control valve assembly comprising, a trigger valve associated with the trigger, and a placing sensor valve associated with the placing sensor; and a safety valve assembly configured to define a locked position and an open position by controlling a first pressure in a first control space and a second pressure in a second control space, wherein in the open position, the main control line is connected to the control valve assembly and wherein in the locked position, the main control line is not connected to the control valve assembly, wherein the first control space is connected to the trigger valve such that an actuation of the trigger valve is configured to bring the safety valve assembly into the locked position, wherein, when the safety valve assembly is in the open position, the second control space is connected to the placing sensor valve such that an actuation of the placing sensor valve is configured to bring the safety valve assembly into the open position when the trigger valve is actuated, wherein the safety valve assembly is in the open position when the first control space and the second control space are aerated.

2. The compressed air nailer according to claim 1, wherein the safety valve assembly comprises an actuating member configured to be displaced between the locked position and the open position, and wherein the first pressure in the first control space exerts a first force onto the actuating member and the second pressure in the second control space exerts a second force onto the actuating member that is counter to the first force.

3. The compressed air nailer according to claim 2, further comprising a spring configured to exert a spring force onto the actuating member in a direction of the open position.

4. The compressed air nailer according to claim 1, wherein each actuation of the trigger valve causes an aeration of the first control space.

5. The compressed air nailer according to claim 1, wherein the trigger valve is configured to be actuated with each actuation of the trigger irrespective of a position of the placing sensor.

6. The compressed air nailer according to claim 1, wherein the placing sensor valve is configured to be actuated with each actuation of the placing sensor irrespective of a position of the trigger.

7. The compressed air nailer according to claim 1, wherein when the safety valve assembly is in the open position, the main control line is connected to an outlet of the placing sensor valve and in that an inlet of the placing sensor valve is connected to an outlet of the trigger valve.

8. The compressed air nailer according to claim 1, further comprising a non-return valve arranged in a line that is configured to connect the placing sensor valve to the second control space when the line is in an open position.

9. The compressed air nailer according to claim 8, wherein the second control space is configured to be deaerated by a throttle, and wherein the second control space is connected to a storage chamber.

10. The compressed air nailer according to claim 1, wherein the safety valve assembly is configured to deaerate at least one of the second control space and the main control line when the safety valve assembly is in the locked position.

11. The compressed air nailer according to claim 10, wherein the safety valve assembly comprises a locking sleeve, and wherein the placing sensor valve is positioned within the locking sleeve.

12. The compressed air nailer according to claim 11, wherein the placing sensor valve comprises a fixed valve sleeve and a displaceable valve pin guided within the fixed valve sleeve, and wherein the locking sleeve surrounds and cooperates with the valve sleeve.

13. The compressed air nailer according to claim 12, further comprising a non-return valve formed by an O-ring inserted into a peripheral groove of the valve sleeve.

14. The compressed air nailer according to claim 9, wherein the storage chamber comprises a first storage chamber and a second storage chamber, and a throttle is configured to connect the first storage chamber and the second storage chamber.

15. The compressed air nailer according to claim 14, further comprising:

a retraction chamber; and a non-return valve configured to connect the retraction chamber configured to connect to the second control space.

16. The compressed air nailer according to claim 14, further comprising a storage chamber aeration valve configured to be activated by the control valve assembly, wherein the storage chamber aeration valve is configured to aerate the second storage chamber.

17. The compressed air nailer according to claim 16, wherein the second control space is configured to be connected to the first storage chamber.

* * * * *